US010392217B2

(12) United States Patent
Case et al.

(10) Patent No.: US 10,392,217 B2
(45) **Date of Patent: *Aug. 27, 2019**

(54) AUTOMATIC PAPER PRODUCT DISPENSER WITH DATA COLLECTION AND METHOD

(71) Applicant: GPCP IP Holdings LLC, Atlanta, GA (US)

(72) Inventors: Abby Catherine Case, Green Bay, WI (US); David James Gennrich, Fitchburg, WI (US); Scott A. Woods, Delavan, WI (US); Chad Anthony Schweitzer, Fitchburg, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/926,697

(22) Filed: Mar. 20, 2018

(65) Prior Publication Data

US 2018/0208424 A1 Jul. 26, 2018

Related U.S. Application Data

(63) Continuation of application No. 15/464,156, filed on Mar. 20, 2017, now Pat. No. 9,963,314, which is a (Continued)

(51) Int. Cl.
*A47K 10/32* (2006.01)
*B65H 26/06* (2006.01)
(Continued)

(52) U.S. Cl.
CPC ..... *B65H 26/06* (2013.01); *A47K 10/3612* (2013.01); *A47K 10/3618* (2013.01);
(Continued)

(58) Field of Classification Search
CPC ..... B65H 26/06; B65H 45/142; B65H 35/10; B65H 16/005; B65H 2701/1924;
(Continued)

(56) References Cited

U.S. PATENT DOCUMENTS 390,328 A 10/1888 Wheeler
400,913 A 4/1889 Hicks
(Continued)

FOREIGN PATENT DOCUMENTS

AU 654722 11/1994
CA 2633158 A1 12/2009
(Continued)

OTHER PUBLICATIONS

International Search Report and Written Opinion for PCT/US2014/015524; dated May 9, 2014; 15 pages.
(Continued)

*Primary Examiner* — Jeremy R Severson

(57) ABSTRACT

Sheet product dispensers and methods are provided. A sheet product dispenser includes a loading station for sheet material, a sheet feeding mechanism configured to feed the sheet material, a presentation station for presenting one or more discrete sheet products to an end user, a sensor downstream of the feeding mechanism and upstream of the presentation station configured to detect a presence of the discrete sheet products, and a controller configured to facilitate dispensing of the one or more discrete sheet products in response to a signal, and to determine and store data associated with the dispensing of the sheet products.

20 Claims, 7 Drawing Sheets

Related U.S. Application Data continuation of application No. 14/043,501, filed on Oct. 1, 2013, now Pat. No. 9,604,811.

(51) Int. Cl.

| | |
|---|---|
| ***B65H 16/00*** | (2006.01) |
| ***B65H 35/10*** | (2006.01) |
| ***B65H 45/14*** | (2006.01) |
| ***A47K 10/36*** | (2006.01) |
| ***A47K 10/44*** | (2006.01) |

(52) U.S. Cl.

CPC ..... *A47K 10/3625* (2013.01); *A47K 10/44* (2013.01); *B65H 16/005* (2013.01); *B65H 35/10* (2013.01); *B65H 45/142* (2013.01); *A47K 2010/3226* (2013.01); *A47K 2010/3668* (2013.01); *B65H 2511/11* (2013.01); *B65H 2551/10* (2013.01); *B65H 2553/27* (2013.01); *B65H 2701/1924* (2013.01); *B65H 2801/12* (2013.01); *Y10T 225/321* (2015.04); *Y10T 225/393* (2015.04)

(58) Field of Classification Search

CPC .... B65H 2511/30; A47K 10/34; A47K 10/36; A47K 10/3606; A47K 10/3625; A47K 2010/3668

See application file for complete search history.

(56) References Cited

U.S. PATENT DOCUMENTS

| | | | |
|---|---|---|---|
| 453,003 | A | 5/1891 | Hicks |
| 459,516 | A | 9/1891 | Wheeler |
| 511,983 | A | 1/1894 | Wheeler |
| 607,498 | A | 7/1898 | Wheeler |
| 1,540,876 | A | 6/1925 | Dwyer |
| 2,007,544 | A | 7/1935 | Meisel |
| 2,053,786 | A | 9/1936 | Straubel |
| 2,105,707 | A | 1/1938 | Stancliff |
| 2,328,109 | A | 8/1943 | Thompson |
| 2,390,399 | A | 12/1945 | Tator et al. |
| 2,637,503 | A | 5/1953 | Birr |
| 2,668,022 | A | 2/1954 | Fairfield |
| 2,693,321 | A | 11/1954 | Birr |
| 2,726,823 | A | 12/1955 | Jespersen |
| 2,993,658 | A | 7/1961 | Sweeney |
| 3,040,943 | A | 6/1962 | Bump |
| 3,276,706 | A | 10/1966 | House |
| 3,326,365 | A | 6/1967 | Neureuther et al. |
| 3,570,335 | A | 3/1971 | Marin |
| 3,592,161 | A | 7/1971 | Hoffman |
| 3,845,289 | A | 10/1974 | French |
| 3,861,985 | A | 1/1975 | Parlagreco |
| 3,877,576 | A | 4/1975 | Kishi et al. |
| 3,935,802 | A | 2/1976 | Perrin et al. |
| 3,995,582 | A | 12/1976 | Douglas |
| 4,134,521 | A | 1/1979 | Pecht |
| 4,236,679 | A | 12/1980 | Jespersen |
| 4,317,547 | A | 3/1982 | Graham et al. |
| 4,378,912 | A | 4/1983 | Perrin et al. |
| 4,403,748 | A | 9/1983 | Cornell |
| 4,457,964 | A | 7/1984 | Kaminstein |
| 4,467,974 | A | 8/1984 | Crim |
| 4,521,209 | A | 6/1985 | DuFresne |
| 4,552,315 | A | 11/1985 | Granger |
| 4,566,608 | A | 1/1986 | Draper et al. |
| 4,621,755 | A | 11/1986 | Granger |
| 4,627,117 | A | 12/1986 | Morishita |
| 4,643,705 | A | 2/1987 | Bober |
| 4,648,530 | A | 3/1987 | Granger |
| 4,651,895 | A | 3/1987 | Niske et al. |
| 4,691,503 | A | 9/1987 | Frerich |
| 4,753,369 | A | 6/1988 | Morrison |
| 47,569,485 | | 7/1988 | Bastian et al. |
| 4,802,412 | A | 2/1989 | Edwards et al. |
| 4,807,824 | A | 2/1989 | Gains et al. |
| 4,846,412 | A | 7/1989 | Morand |
| 4,856,724 | A | 8/1989 | Jespersen |
| 4,905,868 | A | 3/1990 | Beane et al. |
| 4,944,466 | A | 7/1990 | Jespersen |
| 4,982,337 | A | 1/1991 | Burr et al. |
| 5,044,873 | A | 9/1991 | Vijuk |
| 5,048,809 | A | 9/1991 | Tebbe et al. |
| 5,054,676 | A | 10/1991 | Ban |
| 5,131,302 | A | 7/1992 | Watanabe |
| 5,135,147 | A | 8/1992 | Granger |
| 5,205,454 | A | 4/1993 | Schutz et al. |
| RE34,288 | E | 6/1993 | Beck et al. |
| 5,244,161 | A | 9/1993 | Wirtz-Odenthal |
| 5,246,137 | A | 9/1993 | Schutz et al. |
| 5,310,398 | A | 5/1994 | Yoneyama |
| 5,348,527 | A | 9/1994 | Beckwith |
| 5,364,332 | A | 11/1994 | Gray |
| 5,370,267 | A | 12/1994 | Schroeder |
| 5,371,267 | A | 12/1994 | Seitz et al. |
| 5,439,521 | A | 8/1995 | Rao |
| 5,496,605 | A | 3/1996 | Augst et al. |
| 5,526,973 | A | 6/1996 | Boone et al. |
| 5,582,362 | A | 12/1996 | Johnson et al. |
| 5,625,659 | A | 4/1997 | Sears |
| 5,630,526 | A | 5/1997 | Moody |
| 5,691,919 | A | 11/1997 | Gemmell et al. |
| 5,704,566 | A | 1/1998 | Schutz et al. |
| 5,715,971 | A | 2/1998 | Moreand |
| 5,757,664 | A | 5/1998 | Rogers et al. |
| 5,765,718 | A | 6/1998 | Grasso et al. |
| 5,785,274 | A | 7/1998 | Johnson |
| 5,836,862 | A | 11/1998 | Granger |
| 5,846,412 | A | 12/1998 | Tharp |
| 5,868,275 | A | 2/1999 | Moody |
| 5,878,381 | A | 3/1999 | Gemmell et al. |
| 5,918,197 | A | 6/1999 | Toussant et al. |
| 5,979,822 | A | 11/1999 | Morand et al. |
| 6,000,429 | A | 12/1999 | Van Marcke |
| 6,010,090 | A | 1/2000 | Bushmaker et al. |
| 6,029,921 | A | 2/2000 | Johnson |
| 6,059,711 | A | 5/2000 | Wang |
| 6,065,639 | A | 5/2000 | Maddox et al. |
| 6,090,467 | A | 7/2000 | Yip |
| 6,092,726 | A | 7/2000 | Toussant et al. |
| 6,109,473 | A | 8/2000 | Neveu et al. |
| 6,129,240 | A | 10/2000 | Morand |
| 6,145,779 | A | 11/2000 | Johnson et al. |
| 6,145,782 | A | 11/2000 | King et al. |
| 6,152,397 | A | 11/2000 | Purcell |
| 6,189,163 | B1 | 2/2001 | Ban Marcke |
| 6,228,454 | B1 | 5/2001 | Johnson et al. |
| 6,237,871 | B1 | 5/2001 | Morand et al. |
| 6,352,172 | B1 | 3/2002 | Chan et al. |
| 6,360,181 | B1 | 3/2002 | Gemmell et al. |
| 6,375,038 | B1 | 4/2002 | Daansen et al. |
| 6,401,045 | B1 | 6/2002 | Rogers et al. |
| 6,404,837 | B1 | 6/2002 | Thompson et al. |
| 6,411,920 | B1 | 6/2002 | McConnell et al. |
| 6,440,052 | B1 | 8/2002 | Reider et al. |
| 6,447,864 | B2 | 9/2002 | Johnson et al. |
| 6,460,727 | B1 | 10/2002 | Irwin |
| 6,464,120 | B1 | 10/2002 | Johnson et al. |
| 6,519,505 | B2 | 2/2003 | Formon |
| 6,536,624 | B2 | 3/2003 | Johnson et al. |
| 6,561,598 | B2 | 5/2003 | Granger |
| 6,581,500 | B1 | 6/2003 | Kietaibl |
| 6,592,013 | B1 | 7/2003 | Fujiwara |
| 6,592,067 | B2 | 7/2003 | Denen et al. |
| 6,622,888 | B2 | 9/2003 | Boone et al. |
| 6,644,503 | B2 | 11/2003 | Peterson |
| 6,651,922 | B1 | 11/2003 | Quimpo |
| 6,684,751 | B2 | 2/2004 | Kapiloff et al. |
| 6,685,074 | B2 | 2/2004 | Gracyalny et al. |
| 6,691,061 | B1 | 2/2004 | Rogers et al. |
| 6,704,616 | B2 | 3/2004 | Formon |
| 6,704,617 | B2 | 3/2004 | Cherfane et al. |
| 6,707,873 | B2 | 3/2004 | Thompson et al. |

(56) References Cited

U.S. PATENT DOCUMENTS 6,736,348 B1 5/2004 Formon et al.
6,826,991 B1 12/2004 Rasmussen
6,838,887 B2 1/2005 Denen et al.
6,860,447 B2 3/2005 Boone et al.
6,871,815 B2 3/2005 Moody et al.
6,874,653 B2 4/2005 Boone et al.
6,883,563 B2 4/2005 Smith
6,884,209 B2 4/2005 Roozrokh
6,889,970 B2 5/2005 Takahashi et al.
6,892,898 B1 5/2005 Boone et al.
6,895,296 B2 5/2005 Holt et al.
6,909,986 B2 6/2005 Rogers et al.
6,915,980 B2 7/2005 Tsuruga
6,925,397 B2 8/2005 Rogers et al.
6,934,644 B2 8/2005 Rogers et al.
6,954,395 B2 10/2005 Rolandi
6,959,885 B2 11/2005 King
6,964,395 B1 11/2005 Lewis et al.
6,997,094 B2 2/2006 Granger
7,044,421 B1 5/2006 Omdoll et al.
7,063,656 B1 6/2006 Lindsay
7,066,070 B2 6/2006 Granger et al.
7,072,738 B2 7/2006 Bonney et al.
7,085,618 B2 8/2006 Holt et al.
7,122,005 B2 10/2006 Shusterman
7,131,609 B1 11/2006 Lewis et al.
7,137,539 B2 11/2006 Jackson
7,168,602 B2 1/2007 Broehl
7,177,725 B2 2/2007 Nortier et al.
7,177,780 B2 2/2007 Hillam et al.
7,178,561 B2 2/2007 Memmott et al.
7,181,361 B2 2/2007 Memmott et al.
7,185,683 B2 3/2007 Hillam et al.
7,197,409 B2 3/2007 Hillam et al.
7,213,782 B2 5/2007 Osborne et al.
7,234,610 B2 6/2007 Skarda et al.
7,237,744 B2 7/2007 Morris
7,242,307 B1 7/2007 LeBlond et al.
7,275,655 B2 10/2007 Duff
7,275,672 B2 10/2007 Haen et al.
7,346,427 B2 3/2008 Hillam et al.
7,370,824 B1 5/2008 Osborne
7,370,826 B2 5/2008 Neveu
7,411,511 B2 8/2008 Kennish et al.
7,416,162 B2 8/2008 Behroozi
7,423,533 B1 9/2008 LeBlond et al.
7,454,267 B2 11/2008 Bonney et al.
7,536,264 B2 5/2009 Hillam et al.
7,546,256 B2 6/2009 Hillam et al.
7,574,385 B2 8/2009 Hillam et al.
7,590,467 B2 9/2009 Holt et al.
7,606,632 B2 10/2009 Roberts
7,689,371 B2 3/2010 Memmott et al.
7,726,599 B2 6/2010 Lewis et al.
7,774,096 B2 8/2010 Goerg et al.
7,783,380 B2 8/2010 York et al.
7,783,435 B2 8/2010 Hillam et al.
7,791,490 B2 9/2010 Kennish et al.
7,805,340 B2 9/2010 Blakeslee et al.
7,806,291 B2 10/2010 Anderson
7,814,582 B2 10/2010 Reddy et al.
7,832,678 B2 11/2010 Hjort et al.
7,837,077 B2 11/2010 Formon et al.
7,855,651 B2 12/2010 LeBlond et al.
7,954,405 B2 6/2011 Kling
7,955,797 B2 6/2011 McManus et al.
7,966,879 B2 6/2011 Dietz et al.
7,967,235 B2 6/2011 Forman et al.
7,971,514 B2 7/2011 Alalu
7,975,955 B2 7/2011 Takeuchi
7,996,108 B2 8/2011 Yardley
8,066,217 B2 11/2011 Cittadino et al.
8,079,542 B2 * 12/2011 Troutman ..... A47K 10/36 242/563.2
8,094,029 B2 1/2012 Ortiz et al.
8,160,742 B2 4/2012 Goerg et al.
8,181,899 B2 5/2012 Marietta-Tondin et al.
8,245,879 B2 8/2012 Wegelin
8,298,640 B2 10/2012 Cattacin et al.
8,342,360 B2 1/2013 Long
8,350,706 B2 1/2013 Wegelin et al.
8,364,546 B2 1/2013 Yenni et al.
8,366,035 B2 2/2013 Kling et al.
8,517,618 B2 8/2013 Cartwright et al.
8,590,738 B2 11/2013 Formon
8,616,486 B2 12/2013 Billman et al.
8,662,346 B2 3/2014 Langen et al.
8,899,509 B2 12/2014 Hjort et al.
8,939,392 B2 1/2015 Granger
9,108,436 B1 * 8/2015 Yamamoto ..... B41J 2/325
9,290,019 B2 * 3/2016 Nakayama ..... B41J 11/0095
9,440,456 B2 * 9/2016 Sekino ..... B41J 11/50
9,604,811 B2 * 3/2017 Case ..... B65H 16/005
9,701,508 B2 7/2017 Diamond
9,770,143 B2 9/2017 Corley et al.
9,963,314 B2 * 5/2018 Case ..... B65H 26/06
9,987,863 B2 * 6/2018 Sanada ..... B41J 11/0095
2002/0030061 A1 3/2002 Formon
2002/0033405 A1 3/2002 Gergek
2002/0139488 A1 10/2002 Parker
2003/0109368 A1 6/2003 Kitai et al.
2003/0169046 A1 9/2003 Morris
2003/0183717 A1 10/2003 Chen et al.
2004/0254054 A1 12/2004 Suzuki et al.
2005/0065644 A1 3/2005 Gardner, Jr.
2005/0067519 A1 3/2005 King
2005/0156081 A1 7/2005 Schaeffer
2006/0089544 A1 4/2006 Williams, Jr. et al.
2006/0157148 A1 7/2006 Hillam et al.
2006/0167967 A1 7/2006 Defosse
2006/0175344 A1 8/2006 Skarda et al.
2006/0273100 A1 12/2006 Cittadino et al.
2007/0090132 A1 4/2007 Williams et al.
2007/0098944 A1 5/2007 Mitchell, Jr.
2008/0004507 A1 1/2008 Williams, Jr. et al.
2008/0073371 A1 3/2008 Neiberger et al.
2008/0173661 A1 7/2008 Nevue
2008/0185395 A1 8/2008 Sahud
2008/0197142 A1 8/2008 Langen et al.
2008/0280088 A1 11/2008 Baum
2009/0120951 A1 5/2009 Titas et al.
2009/0125424 A1 5/2009 Wegelin
2009/0155512 A1 6/2009 Neto et al.
2009/0204256 A1 8/2009 Wegelin
2009/0212153 A1 8/2009 Alalu
2009/0319072 A1 12/2009 Fukui
2010/0075094 A1 3/2010 Cattacin et al.
2010/0094581 A1 4/2010 Cagle
2010/0114366 A1 5/2010 Case et al.
2010/0170979 A1 7/2010 Lewis
2010/0224647 A1 9/2010 Formon et al.
2010/0304945 A1 12/2010 Ang
2011/0011886 A1 1/2011 Zaima et al.
2011/0132920 A1 6/2011 Petocchi et al.
2011/0139920 A1 6/2011 Formon et al.
2011/0163870 A1 7/2011 Snodgrass
2011/0168831 A1 7/2011 Mok et al.
2011/0169643 A1 7/2011 Cartner
2011/0169645 A1 7/2011 Cartner et al.
2011/0169646 A1 7/2011 Raichman
2011/0177278 A1 7/2011 Neto et al.
2011/0184864 A1 7/2011 Mon et al.
2011/0210137 A1 9/2011 King
2011/0226883 A1 9/2011 Forman et al.
2011/0232367 A1 9/2011 McManus et al.
2011/0233254 A1 9/2011 Lundqvist et al.
2011/0252883 A1 10/2011 Dietz et al.
2011/0254214 A1 10/2011 Walsh
2011/0316701 A1 12/2011 Alper et al.
2011/0319244 A1 12/2011 Toyoizumi et al.
2012/0037746 A1 2/2012 Cittadino et al.
2012/0055272 A1 * 3/2012 Sanada ..... B41J 15/042 73/865.8
2012/0138625 A1 6/2012 Case et al.

(56) References Cited

U.S. PATENT DOCUMENTS

| | | | |
|---|---|---|---|
| 2012/0218106 | A1 | 8/2012 | Zaima et al. |
| 2012/0235313 | A1 | 9/2012 | Yan et al. |
| 2012/0237711 | A1 | 9/2012 | Cattacin et al. |
| 2012/0245729 | A1 | 9/2012 | Wegelin et al. |
| 2012/0249331 | A1 | 10/2012 | Wegelin et al. |
| 2012/0256037 | A1 | 10/2012 | Nordlund |
| 2013/0040089 | A1 | 2/2013 | Cattacin et al. |
| 2013/0052408 | A1 | 2/2013 | Carlson |
| 2013/0161346 | A1 | 6/2013 | Wolme et al. |
| 2014/0263387 | A1 | 9/2014 | Muehl et al. |
| 2015/0102048 | A1 | 4/2015 | Case et al. |
| 2015/0282678 | A1 | 10/2015 | Larsson et al. |
| 2016/0088982 | A1 | 3/2016 | Larsson et al. |
| 2017/0188759 | A1 | 7/2017 | Borke |
| 2017/0190535 | A1 | 7/2017 | Case |
| 2017/0258278 | A1 | 9/2017 | Moody et al. |
| 2017/0290473 | A1 | 10/2017 | Borke et al. |
| 2017/0296004 | A1 | 10/2017 | Borke |
| 2018/0325334 | A1 | 11/2018 | Casper et al. |

FOREIGN PATENT DOCUMENTS

| | | | |
|---|---|---|---|
| CN | 101068494 | A | 11/2007 |
| DE | 20107189 | U1 | 7/2001 |
| DE | 10256295 | A1 | 7/2003 |
| DE | 20314147 | U1 | 12/2003 |
| EP | 0865247 | | 3/2002 |
| EP | 930039 | | 11/2002 |
| GB | 2377204 | | 1/2003 |
| GB | 2489965 | A | 10/2012 |
| JP | 63051254 | | 3/1988 |
| JP | 6-22882 | | 2/1994 |
| JP | 7-69529 | | 3/1995 |
| JP | H11178741 | A | 7/1999 |
| JP | 11244184 | A | 3/2000 |
| JP | 2002-17601 | | 1/2002 |
| JP | 2003-144344 | | 5/2003 |
| JP | 2003-290072 | | 10/2003 |
| JP | 2004-129863 | | 4/2004 |
| JP | 2005-065730 | | 3/2005 |
| JP | 2009039226 | A | 2/2009 |
| NL | 1036213 | A1 | 1/2009 |
| WO | 97/21377 | | 6/1988 |
| WO | 98/37794 | A1 | 9/1998 |
| WO | 2010/141689 | A2 | 12/2010 |
| WO | 2011/074946 | A1 | 6/2011 |
| WO | 2012/034590 | A1 | 3/2012 |
| WO | 2012/102608 | A1 | 8/2012 |
| WO | 2013/119940 | A1 | 8/2013 |
| WO | 2014/118483 | A1 | 8/2014 |

OTHER PUBLICATIONS

International Search Report and Written Opinion for PCT/FR2007/001737; dated Oct. 31, 2008; 20 pages.

International Search Report and Written Opinion for PCT/US2014/058283, dated Jan. 15, 2015, 11 pages.

Georgia-Pacific LLC, "Relevant Information Regarding Other Georgia Pacific Towel & Tissue Dispensers," Mar. 2013, 1 page.

International Search Report and Written Opinion for International Application No. PCT/US2013/025334 dated May 15, 2013.

Nilsson, Ulrika and Volme, Lisa; ReDesign of RollNap, a Technical and Aesthetical Development of a Napkin Dispenser; University Essay from Lunds Universitet/Maskinkonstruktion; LTH; 2010, 121 pages; http://www.essays.se/essay/1629aeca878/.

Supplementary European Search Report for Application No. 13 74 6627.2 dated Mar. 16, 2016.

International Search Report and Written Opinion for International Application No. PCT/US2015/066015 dated Apr. 8, 2016.

Supplementary European Search Report for Application No. 14 85 1269.2 dated Mar. 3, 2017.

* cited by examiner

AUTOMATIC PAPER PRODUCT DISPENSER WITH DATA COLLECTION AND METHOD

CROSS-REFERENCE TO RELATED APPLICATIONS

This application is continuation of U.S. patent application Ser. No. 15/464,156, filed Mar. 20, 2017, which is a continuation of U.S. patent application Ser. No. 14/043,501, filed Oct. 1, 2013, now U.S. Pat. No. 9,604,811, issued Mar. 28, 2017, which are incorporated by reference herein.

TECHNICAL FIELD

The present disclosure relates generally to the field of paper dispensers, and more particularly to automatic paper dispensers for dispensing discrete paper products therefrom.

BACKGROUND

Paper dispensers, such as paper towel or napkin dispensers, are generally configured to allow an end user to retrieve paper products therefrom. Conventional discrete paper products dispensers enable users to obtain an unlimited number of paper products with no control mechanism. For example, quick service restaurants employ manual napkin dispensers from which end users may take an unlimited number of napkins. As such, excessive paper product distribution and waste may occur, leading to increased operating expensive.

Moreover, conventional discrete product dispensers are incapable of monitoring product usage and collecting and storing data associated with product dispensing. It would be desirable for product dispensers to be able to monitor usage trends to increase understanding of usage rates, so that dispensers can be adjusted to deliver products efficiently according to observed user needs.

Accordingly, there is a need for improved paper product dispensers that allow for economical and efficient dispensing of discrete paper products.

SUMMARY

In one aspect, a sheet product dispenser is provided, including: (i) a loading station for loading sheet material; (ii) a sheet feeding mechanism configured to feed the sheet material; (iii) a presentation station for presenting one or more of the discrete sheet products to an end user; (iv) a sensor downstream of the sheet feeding mechanism and upstream of the presentation station, the sensor being configured to detect a presence of the discrete sheet products; and (v) a controller configured to facilitate dispensing of the one or more discrete sheet products to the presentation station in response to a signal, the controller also being configured to receive and store data, wherein the data includes: a number of requested discrete sheet products associated with the signal, a number of discrete sheet products detected by the sensor, a time at which the one or more discrete sheet products are detected by the sensor, a time at which the signal is received by the controller, an amount of time between the signal being received by the controller and the one or more discrete sheet products being detected by the sensor, or a combination thereof.

In another aspect, a method of dispensing sheet products is provided, including: (i) feeding a sheet material via a sheet feeding mechanism; (ii) dispensing one or more discrete sheet products to an end user at a presentation station, in response to a signal received by a controller; (iii) detecting a presence of the discrete sheet products via a sensor downstream of the sheet feeding mechanism and upstream of the presentation station; and (iv) collecting and storing data including: a number of requested discrete sheet products associated with the signal, a number of discrete sheet products detected by the sensor, a time at which the one or more discrete sheet products are detected by the sensor, a time at which the signal is received by the controller, an amount of time between the signal being received by the controller and the one or more discrete sheet products being detected by the sensor, or a combination thereof.

In yet another aspect, a system for dispensing sheet products is provided, including at least one memory that stores computer-executable instructions, and at least one controller configured to access the at least one memory, wherein the at least one controller is configured to execute the computer-executable instructions to: (i) receive, from an interface, a signal indicative of a request for a number of discrete sheet products to be dispensed to an end user at a presentation station; (ii) direct, in response to receipt of the signal, the feeding of a sheet material via a sheet feeding mechanism; (iii) receive, from a sensor downstream of the sheet feeding mechanism and upstream of the presentation station, a detection indicator indicative of detection of a presence of a discrete sheet product by the sensor; (iv) determine data including: a number of requested discrete sheet products associated with the signal, a number of discrete sheet products detected by the sensor, a time at which one or more discrete sheet products are detected by the sensor, a time at which the signal is received by the at least one controller, an amount of time between the signal being received by the at least one controller and the one or more discrete sheet products being detected by the sensor, or a combination thereof; and (v) direct the storage, in one or more data stores, of at least a portion of the data.

In another aspect, a method for dispensing sheet products is provided, including: (i) receiving from an interface, by at least one controller configured to access at least one memory, a signal indicative of a request for a number of discrete sheet products to be dispensed to an end user at a presentation station; (ii) directing, by the at least one controller, in response to receipt of the signal, the feeding of a sheet material via a sheet feeding mechanism; (iii) receiving, by the at least one controller, from a sensor downstream of the sheet feeding mechanism and upstream of the presentation station, a detection indicator indicative of detection of a presence of a discrete sheet product by the sensor; (iv) determining, by the at least one controller, data including: a number of requested discrete sheet products associated with the signal, a number of discrete sheet products detected by the sensor, a time at which one or more discrete sheet products are detected by the sensor, a time at which the signal is received by the at least one controller, an amount of time between the signal being received by the at least one controller and the one or more discrete sheet products being detected by the sensor, or a combination thereof; and (v) directing, by the at least one controller, the storage, in one or more data stores, of at least a portion of the data.

BRIEF DESCRIPTION OF THE DRAWINGS

Referring now to the drawings, which are meant to be exemplary and not limiting, and wherein like elements are numbered alike.

DETAILED DESCRIPTION

Disclosed herein are dispensers and methods for automatically dispensing paper products and determining and storing data associated therewith. These dispensers meet one or more of the above-described needs by providing economical and efficient dispensing of discrete paper products, as well as collection and monitoring of user and dispenser usage data. As used herein, the term "discrete paper products" refers to separated material products, such as individual napkins, paper towels, and the like. Discrete paper products are distinguishable from a continuous roll or web of sheet material. As used herein, the term "continuous roll of sheet material" or "roll of sheet material" refers to a web of sheet material that is provided in a continuous form, such as in a rolled form, for dispensing. The continuous roll of sheet material may include perforations in the sheet material at given intervals.

As used herein, the term "sheet material" may refer to any type of natural and/or synthetic cloth or paper material, including woven and non-woven materials. That is, as used herein, the term "paper products" is intended to cover paper, cloth, cloth-like, or other materials that may be used to form discrete products, such as napkins, towels, or food wrappers. The discrete paper products produced by the dispensers and methods disclosed herein may include a fold in the sheet material. For example, the discrete paper products may be folded napkin or folded towel products. The fold may be a hard fold with a crease therein, or a loose fold with a "U" or "C"-shaped configuration. Multiple folds may also be created in a single discrete sheet product, such as a "Z"-shaped fold or dinner napkin fold.

Embodiments of dispensers and methods are described in detail below, with reference to the drawings, wherein like elements are numbered alike.

Dispensers

Figure 1:
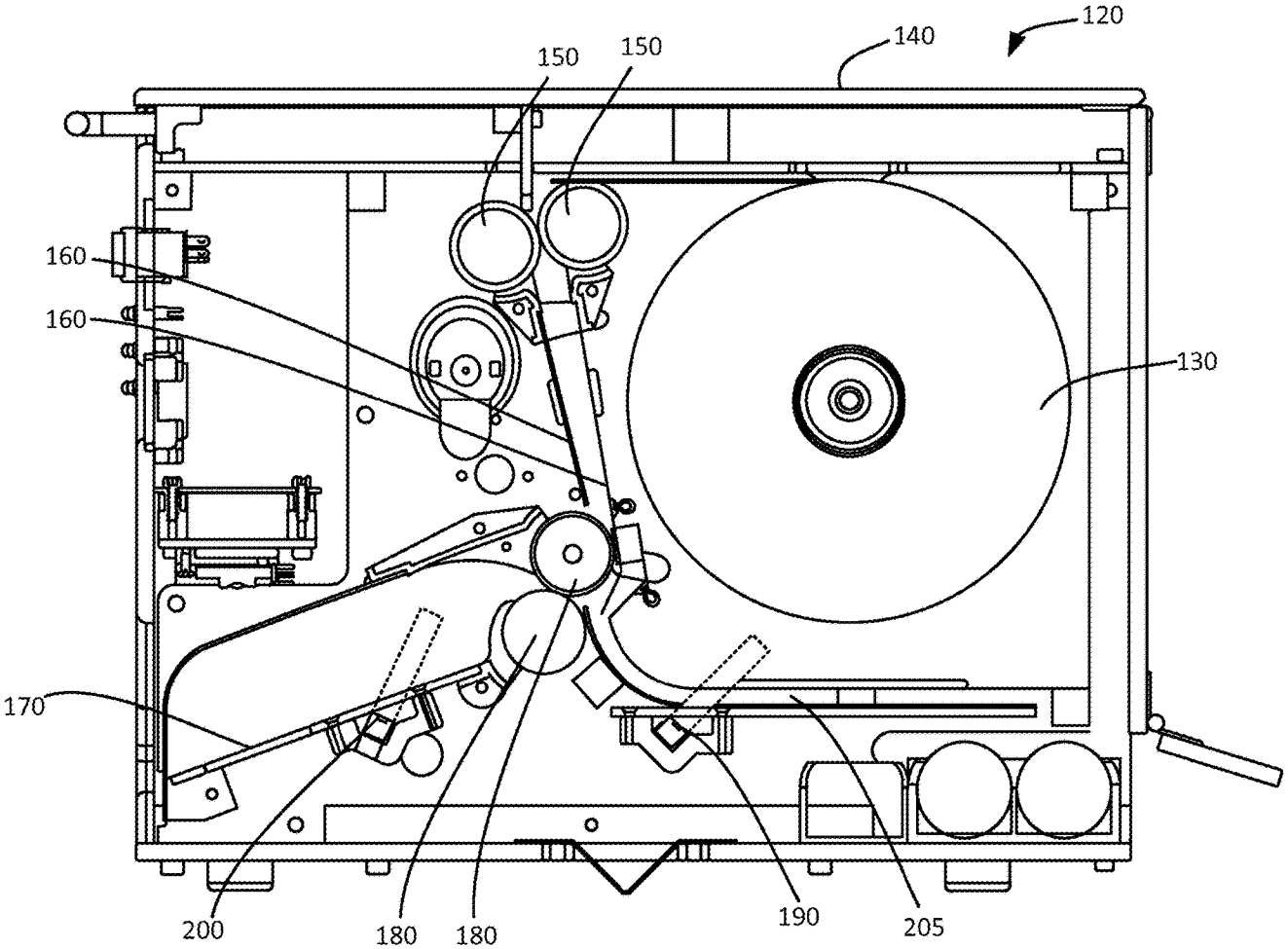
FIG. 1 is a partial side plan view of an automatic paper product dispenser.
Figure 2:
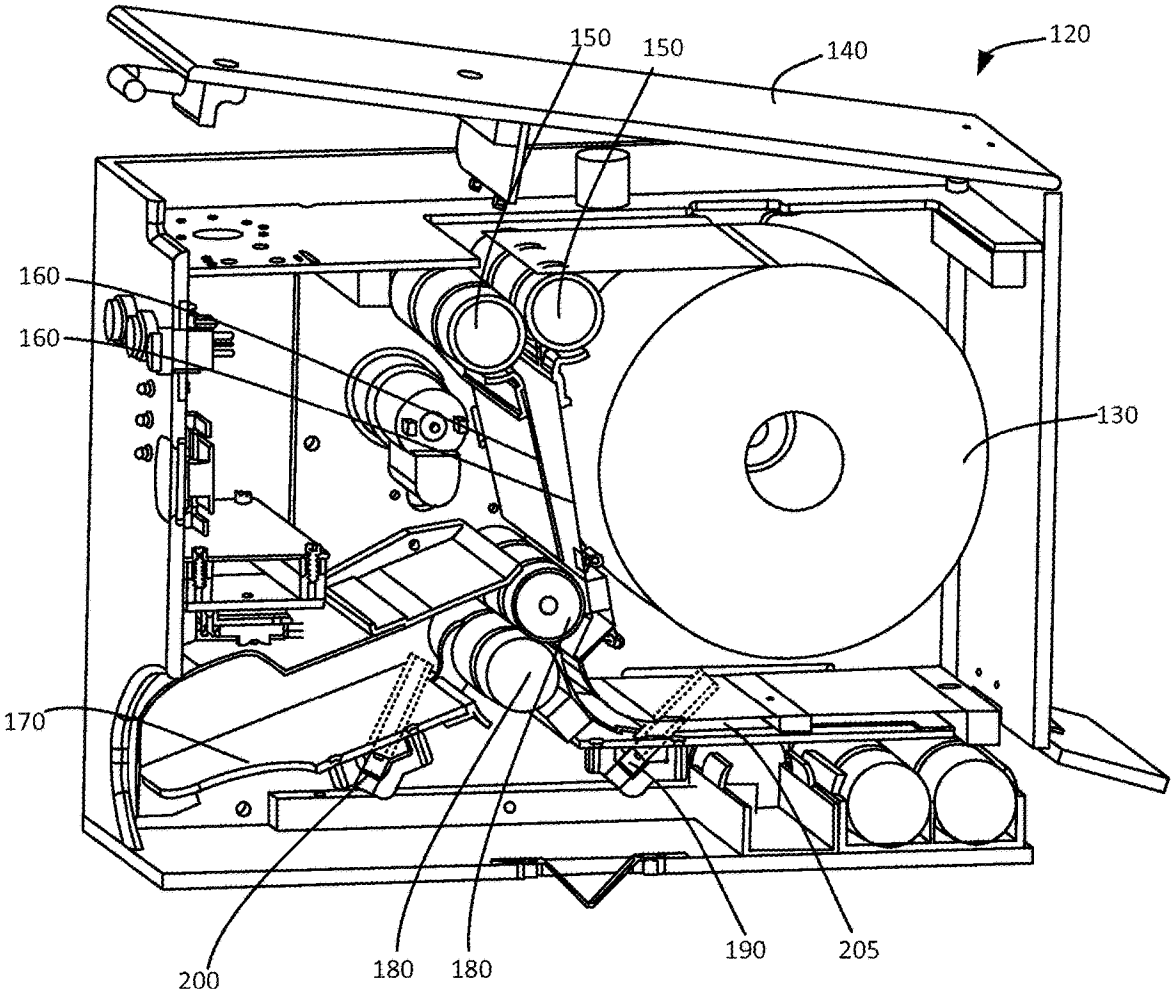
FIG. 2 is a partial perspective view of an automatic paper product dispenser.

As shown in FIGS. 1 and 2, a sheet product dispenser 120 includes a number of stations and mechanisms to produce and dispense discrete sheet products. In certain embodiments, the discrete sheet products are dispensed from a roll of sheet material 130. In other embodiments, the discrete sheet products arte dispensed from a stack of discrete sheet products, such as a stack of pre-folded napkins. For example, a sheet product dispenser may include one or more of: a loading station, a sheet feeding mechanism, a separation mechanism, a folding station, a sheet product conveying mechanism, and a presentation station. Certain dispenser embodiments and features are disclosed in the U.S. Patent Application Publication No. 2012/0138625, published Jun. 7, 2012, which is incorporated herein by reference in its entirety.

In certain embodiments, the stations and mechanisms may be enclosed in whole or in part within an outer dispenser housing or shell. The outer housing may be made of a substantially rigid material.

In embodiments, as shown in FIGS. 1 and 2, the sheet product dispenser 120 includes a loading station for loading the sheet material 130. The loading station accepts the roll of sheet material 130 therein and includes a door 140 loading mechanism. In other embodiments, the loading station may include a slot mechanism with one or more spindle plugs, or a side door with one or more spindles. For example, the outer housing of the dispenser may have one or more loading doors thereon. In certain embodiments, a single dispenser may be configured to house multiple material sheet rolls, such as in a vertical or horizontal stack.

In embodiments, the dispenser also includes a sheet feeding, or transfer, mechanism configured to feed the sheet material from the roll. The sheet feeding mechanism includes feed rollers 150. In other embodiments, the transfer mechanism includes a multi-roller mechanism having two or more rollers. The rollers may be spring loaded and/or motor driven. The sheet feeding mechanism is configured to accept the tail of a roll of sheet material and feed the material further into the dispenser. As shown in FIGS. 1 and 2, feed rollers 150 are configured to feed sheet material from the roll 130 into the chute formed between vertical walls 160. As used herein, the term "tail" refers to the leading end of the sheet material or discrete sheet product.

Figure 3:
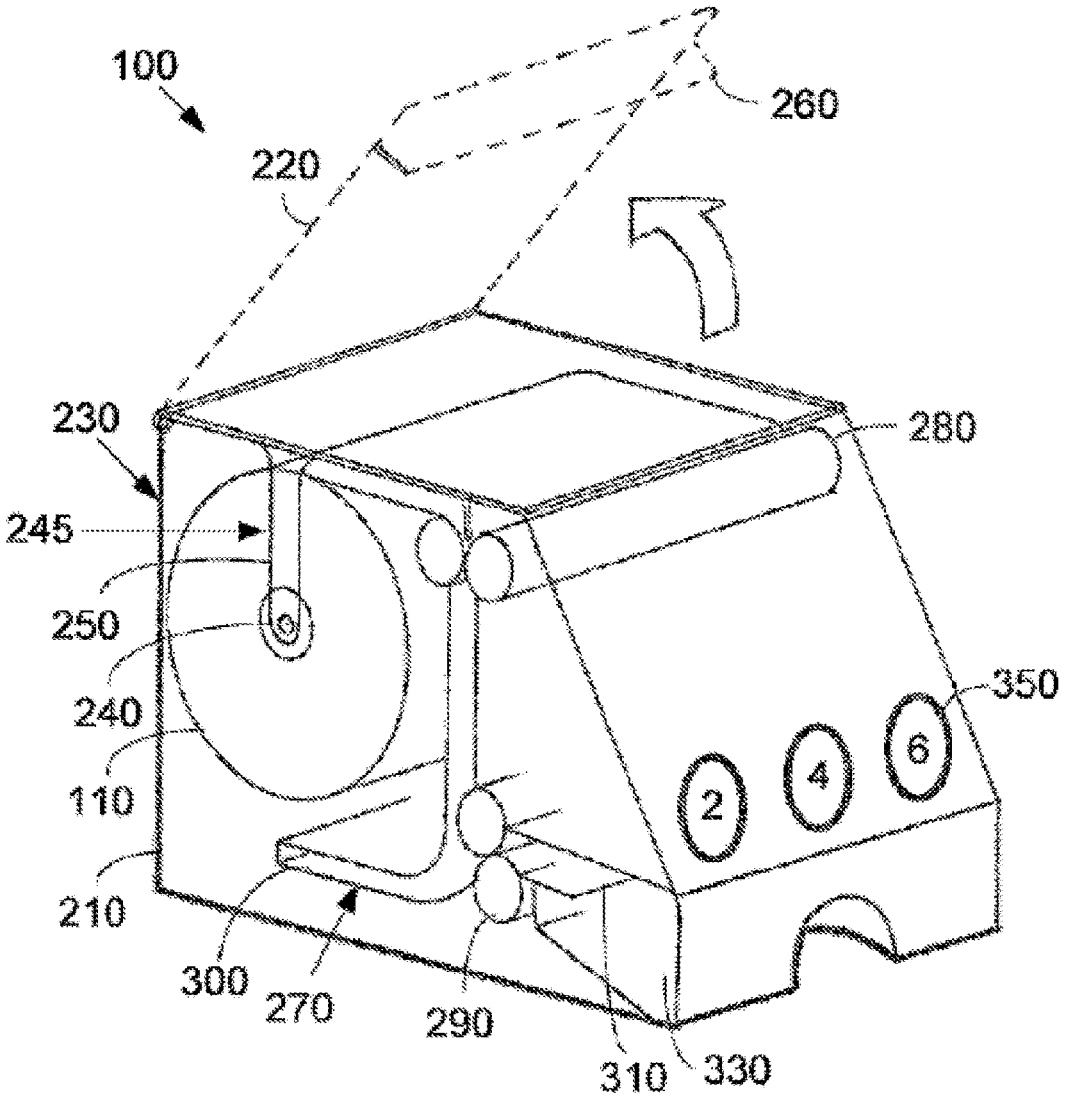
FIG. 3 is a perspective view of an automatic paper product dispenser having a button-based user interface.
Figure 4:
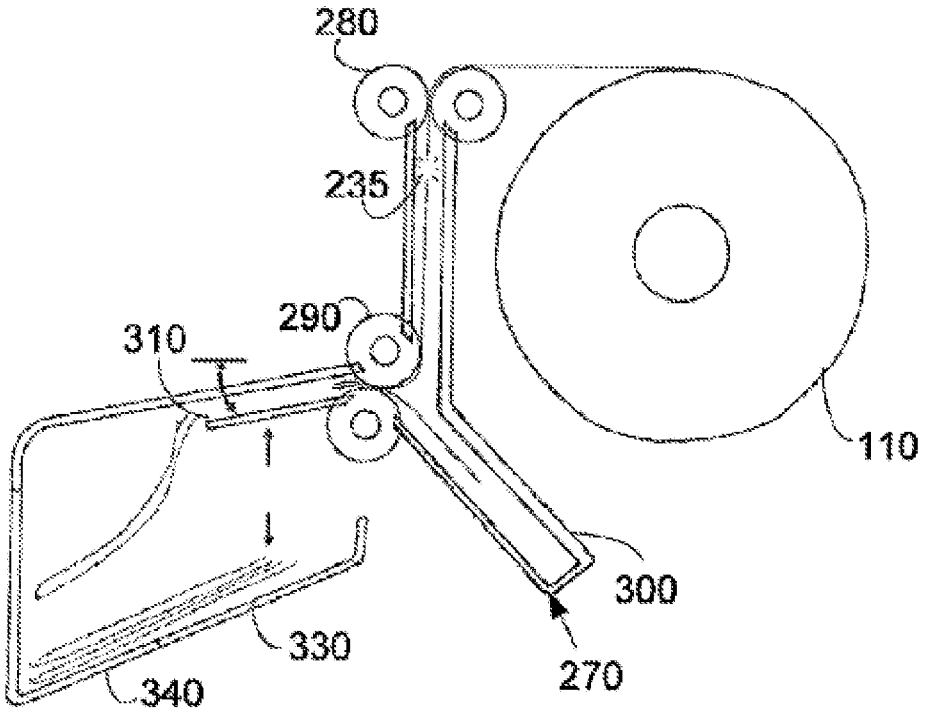
FIG. 4 is a partial side plan view of an automatic paper product dispenser.

As shown in FIGS. 3 and 4, the dispenser 230 may include a single material sheet roll 110. The single material sheet roll 110 may have a number of perforations 235 at substantially uniform intervals. The loading mechanism of the loading station may include a slot mechanism 245 having a pair of spindle plugs 240 in the roll 110 and a pair of slots 250 formed in the outer shell 210 of the dispenser. The slots 250 are configured to accommodate the spindle plugs 240 therein. The loading door 220 also may have a tucker finger 260 sized to assist the feeding the sheet material.

In embodiments, as shown in FIGS. 1 and 2, dispenser 120 also includes a presentation station 170 for presenting one or more discrete sheet products to an end user. The presentation station may be a single slot presentation tray, a multiple slot presentation tray, a partially covered tray, a hidden tray, and/or a vertical hang assembly. As shown in FIG. 4, the presentation station may include a presentation tray 330. The presentation tray 330 may be semi-covered. The presentation tray 330 may include an offset angle 340 so as to stack the paper products therein. The angle of the presentation tray 340 may be about 140 degrees or so. Other angles may also be used. The presentation tray also may have multiple retracting shelves therein.

The dispenser may include a sheet product conveying mechanism configured to convey the discrete sheet products to the presentation station. In one embodiment, as shown in FIGS. 1 and 2, the sheet product conveying mechanism includes a pair of pinch rollers 180. In other embodiments, the conveying mechanism may include a multi-roller mechanism having two or more roller. The rollers may be spring loaded and/or motor driven.

In certain embodiments, the dispenser also includes a separation mechanism for separating discrete sheet products from the continuous roll or web of sheet material. For example, the separate mechanism may include a cutting mechanism, such as a cutter or knife assembly, or a speed differential separation mechanism, such as a multi-roller feed mechanism with a reserve drive conveying mechanism. In one embodiment, as shown in FIGS. 1 and 2, the separation mechanism includes the sheet feeding mechanism 150 being driven at a first speed and the sheet product conveying mechanism 180 being driven at a second speed that is higher than the first speed. The sheet material may be perforated to enhance separation of the discrete sheet products. The separation mechanism advantageously allows the dispenser to be loaded with a roll of sheet product, which is more economical and may occupy less volume than discrete sheet products themselves, and to also dispense discrete sheet products to the end user. Alternatively, the dispenser may be configured to receive and dispense a plurality of pre-separated discrete sheet products, such as pre-cut napkins, which may or may not also be pre-folded.

In embodiments, as shown in FIGS. 1 and 2, the dispenser 120 also includes a sensor 190 downstream of the sheet feeding mechanism 150 and upstream of the presentation station 170. The sensor 190 is configured to detect the presence of a discrete sheet product. For example, the sensor may be located in the lower sheet path beyond the drive rolls. In one embodiment, the sensor is an infrared sensor. In other embodiments, the sensor may be another type of proximity sensor, an optical sensor, a mechanical sensor, or any other suitable sensor type. In certain embodiments, the sensor is upstream of the sheet product conveying mechanism.

In embodiments, the dispenser also includes one or more controllers configured to facilitate dispensing of one or more discrete sheet products to the presentation station in response to a signal. The controller may generally provide logic and control functionality for operation of the dispenser. For example, the controller may be operably connected to one or more motors that are configured to drive the feeding and dispensing mechanisms of the dispenser. The controller may be a suitable electronic device capable of receiving and storing data and instructions. For example, the controller may store data to in any suitable format, such as in an ASCII ".txt" file in a Comma Separated Value (CSV) or text line-item format. In one embodiment, the controller will generate the data file if one does not already exist. In one embodiment, the controller will preserve the existing data and append any new data collected to the existing data.

In embodiments, the dispenser is configured to collect and process a variety of data, including usage, fault, and system performance information. For example, the data may be received and stored by the controller. In certain embodiments, the data includes: the number of requested discrete sheet products associated with the signal, the number of discrete sheet products detected by the sensor, the time at which the discrete sheet products are detected by the sensor, the time at which the signal is received by the controller, the amount of time between the signal being received by the controller and the discrete sheet products being detected by the sensor, or any combination thereof. Advantageously, the collection of this data allows the dispenser to self-verify that the number of paper products dispensed meets the requested number of paper products associated with the signal.

For example, the data may include the actual time of day that paper products are requested and/or dispensed, which would allow the restaurant to track usage rates at meal times. The data may also include: the number of products dispensed per day or hour, the number of products dispensed between dispenser battery charges, the number of product requests received per day or hour, the average time per product dispense, the number of times a loading door is opened per day, the number of dispenser jams per day or hour. Certain data may be collected by additional sensors located within the dispenser. For example, a static electricity sensor may monitor the voltage at the shaft of the first feed roller.

Figure 5:
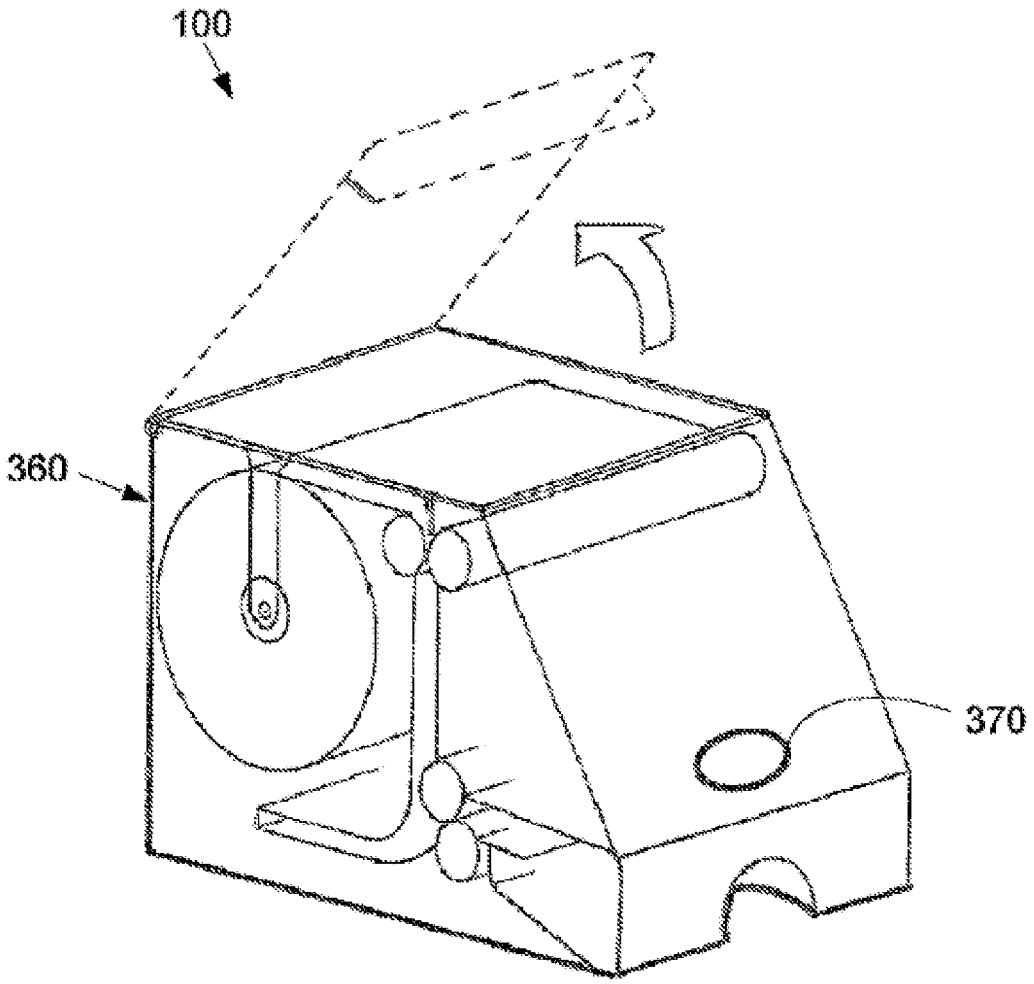
FIG. 5 is a perspective view of an automatic paper product dispenser having a sensor-based user interface.

In embodiments, as shown in FIGS. 3 and 5, the dispenser 100 also includes a user interface configured to allow an end user to select the number of products to be dispensed and/or to initiate a dispense. The user interface may be configured to transmit the signal to the controller such that the controller in response facilitates dispensing a predetermined number of sheet products associated with that signal request. The user interface may be located at or near the presentation station.

In one embodiment, as shown in FIG. 3, the user interface 220 includes one or more buttons 350. The buttons 350 may be any suitable type of mechanical or electrical selector buttons, or other types of buttons. The buttons 350 may indicate the number of paper products to be dispensed. That is, each button may be associated with a predetermined number of discrete sheet products to be dispensed in response to the signal transmitted in response to that button being pressed by an end user. In response to the signal being transmitted from a selected button, the controller may be configured to facilitate dispensing of the predetermined number of sheet products. Thus, a dispense is initiated when the end user presses a button, selecting the number of paper products to be dispensed.

Although three buttons 350 for two, four, and six paper products are shown, any number of paper products may be associated with any number or orientation of the buttons 350. Each button may be programmed with a predetermined number of sheet products to dispense. In one embodiment, a selecting switch is provided inside the dispenser to allow an operator to set the predetermined number of paper products associated with each button. The controller may record data associated with which button was pressed and the time at which the button was pressed. In a quick service restaurant setting, for example, a dispenser having a button-based user interface may be located behind the counter for use by an operator at a drive thru, allowing the operator to select a desired number of paper products for a given order.

In one embodiment, as shown in FIG. 5, dispenser 360 has a user interface that includes one or more sensors 370. Each sensor 370 may be any suitable type of motion sensor such as photoelectric, infrared, and the like, that does not require physical contact. The sensor 370 may be positioned anywhere on the outer housing of the dispenser. Thus, the dispense may be activated by the end user waving his or her hand thereabout.

The dispenser 360 may be set to dispense a predetermined number of paper products for each wave of the end user's hand about the sensor 370. The dispenser 360 may dispense the paper products into the presentation tray or directly into the end user's hand. For example, an internal rotary switch or dial may be configured to be set to the predetermined number of discrete sheet products to be dispensed in response to the signal. The controller may record data associated with which dial/switch position is selected and the time at which the sensor is activated. In a quick service restaurant setting, for example, a dispenser having a sensor-based used interface may be located at a self-serve area for patrons.

In one embodiment, as shown in FIGS. 1 and 2, the dispenser 120 includes an internal sensor 200 configured to detect an absence of discrete sheet products at the presentation station 170, and transmit the signal to the controller upon detection of the absence of discrete sheet products at the presentation station 170. For example, the sensor may be an infrared sensor, another type of proximity sensor, an optical sensor, a mechanical sensor, or any other suitable sensor type. In this embodiment, the "user interface" includes internal sensor 200, which initiates a dispense by transmitting a signal to the controller in response to the presentation station 170 being empty, i.e., that a user has removed all of the paper products from the presentation station. In this embodiment, the controller is configured to facilitate dispensing of a predetermined number of discrete sheet products in response to the signal. The controller may record data such as the time between the discrete sheet products entering the presentation station and the absence of discrete sheet products at the presentation station.

In another embodiment, the signal may be triggered by a cash register. For example, a dispense may be initiated by a signal in response to an order being completed at a cash register. In certain embodiments, the data includes sales, usage, or other data associated with the cash register. Certain integrated dispenser and business machine embodiments and features are disclosed in the U.S. Pat. No. 6,704,616, issued Mar. 9, 2004, which is incorporated herein by reference in its entirety.

In certain embodiments, as shown in FIGS. 1 and 2, a motor is operably connected to the controller and configured to drive the sheet feeding mechanism 150 and the sheet product conveying mechanism 180 in response to the signal. In these embodiments, the data collected by the controller may include a time at which the motor is turned on, a time at which the motor is turned off, and/or a time between the motor bring turned on and the motor bring turned off.

In one embodiment, the controller is configured to compare the number of requested discrete sheet products associated with the signal and the number of discrete sheet products detected by the sensor, and turn off the motor when the number of discrete sheet products detected by the sensor matches the number of requested discrete sheet products associated with the signal.

Generally, the dispensers described herein are configured to record the number of requested sheet products, and recognize when the correct number of sheet products has been dispensed, by counting them with a sensor mounted inside the dispenser as they proceed serially through the conveying mechanism. In certain embodiments, when the correct number of products has been dispensed and the motors which drive the rollers stop, the device reads and records the current time. The current time, the number of products dispensed, and the amount of time required to perform the dispense, among other data, may be recorded to the aforementioned data store, or ".txt" file.

In certain embodiments, the dispenser includes a folding station for providing a fold or crease in the discrete paper products. The folding station advantageously allows the dispenser to be loaded with a roll of sheet product, which is more economical and may occupy less volume than discrete folded sheet products themselves, and to also dispense discrete folded sheet products to the end user. The folding station may include a buckle fold mechanism, a slot fold mechanism, a reverse fold mechanism, a tucker fold mechanism, or any other suitable fold mechanism.

The folding station may be configured to fold the discrete sheet products prior to presentation. In one embodiment, as shown in FIGS. 1 and 2, the folding station includes a buckle chamber 205 adjacent to the conveying station (i.e., the pair of pinch rollers) 180, such that a portion of the sheet material (i.e., the tail) enters the buckle chamber 205 and a fold in the sheet material is forced through the pair of pinch rollers 180. That is, the sheet material is fed by feed rollers 150 from the roll 130 into the chute formed between vertical walls 160, and then is fed into buckle chamber 205, such that a fold is created by pinch rollers 180.

FIGS. 3 and 4 show another embodiment of a paper product dispenser 100 having a buckle-type folding station. The folding station includes a buckle fold mechanism 270, which includes a first pair of pinch rollers 280 (i.e., feed rollers) and a second pair of pinch rollers 290. The buckle fold mechanism 270 also includes a buckle tray 300 and a dispense shelf 310. The first pair of pinch rollers 280 may be positioned near the roll 110 and the loading door 220. The second pair of pinch rollers 290 may be positioned downstream near the buckle tray 300 and the dispense shelf 310. The second pair of pinch rollers 290 may be in line with the first pair of pinch rollers 280 as the tail 125 descends. The buckle tray 300 may be sized to accommodate the desired length of the discrete paper product. The pinch rollers 280, 290 may be spring loaded and may be motor driven. Each pair of pinch rollers 280, 290 may be driven at different speeds. Stripper fingers between the pinch rollers also may be used.

In use, the roll 110 may be dropped into the outer shell 210 via the loading door 220 along the slots 250 of the slot mechanism 245. The tail of the roll 110 may be placed over the first pair of pinch rollers 280. The tucker finger 260 on the loading door 220 may push the tail between the first pair of pinch rollers 280 to load the tail 125 therein when the loading door 220 is shut. The buckle fold mechanism 270 creates a fold by driving the tail into the buckle tray 300. Once the tail hits the end of the buckle tray 300, the second pair of pinch rollers 290 drives the fold 135 therethrough. The perforation 235 of the sheet material may be separated based upon a speed differential between the first and the second pair of the pinch rollers 280, 290. The speed differential may be about two to one to separate the perforation 235 between the pinch rollers 280, 290. Once the perforation 235 is separated, the discrete sheet product may drop along the dispense shelf 310 into the presentation tray 330. Specifically, the number of discrete sheet products as indicated by the push buttons 350 may drop into the presentation tray 330. The discrete sheet products may be removed as a group by the end user.

In one embodiment, a folded napkin dispenser includes: a loading station for loading a roll of sheet material; a pair of feed rollers configured to feed the sheet material from the roll; a separation mechanism for separating discrete sheet products from the sheet material; a folding station configured to fold the discrete sheet products into folded napkins, which includes: a pair of pinch rollers downstream of the pair of feed rollers and configured to convey the folded napkins to a presentation station and a buckle chamber adjacent to the pair of pinch rollers, wherein a portion of the sheet material enters the buckle chamber and a fold of the sheet material is forced through the pair of pinch rollers; an infrared sensor configured to detect a presence of the discrete sheet products in the buckle chamber; and a controller configured to facilitate dispensing of one or more folded napkins to the presentation station in response to a signal, the controller also being configured to receive and store data, wherein the data includes: a number of requested folded napkins associated with the signal, a number of discrete sheet products detected by the sensor, a time at which the one or more discrete sheet products are detected by the sensor, a time at which the signal is received by the controller, and/or an amount of time between the signal being received by the controller and the one or more discrete sheet products being detected by the sensor.

The paper product dispensers described herein may take many different sizes, shapes, and configurations, and may use various combinations and configurations of components. The components described with reference to one or more embodiments may be interchangeable, such that the dispensers are not limited to the given components or configurations of any one embodiment.

Methods

In certain embodiments, methods of dispensing sheet products include: (i) feeding a sheet material via a sheet feeding mechanism, (ii) dispensing one or more discrete sheet products to an end user at a presentation station, in response to a signal received by a controller, (iii) detecting a presence of the discrete sheet products via a sensor downstream of the sheet feeding mechanism and upstream of the presentation station, (iv) and collecting and storing data including: a number of requested discrete sheet products associated with the signal, a number of discrete sheet products detected by the sensor, a time at which the one or more discrete sheet products are detected by the sensor, a time at which the signal is received by the controller, an amount of time between the signal being received by the controller and the one or more discrete sheet products being detected by the sensor, or a combination thereof. These methods may incorporate any suitable combination of the mechanisms, stations, and other dispenser features described herein.

In one embodiment, the sheet material is fed from a roll, and the method further includes separating discrete sheet products from the roll. In certain embodiments, the one or more discrete sheet products are dispensed via a sheet product conveying mechanism and the sensor is upstream of the sheet product conveying mechanism.

In certain embodiments, the method includes transmitting the signal to the controller from a user interface. For example, the user interface may be sensor or button-based. In one embodiment, the method includes detecting an absence of discrete sheet products at a presentation station and transmitting the signal to the controller upon detection of the absence of discrete sheet products at the presentation station, wherein the dispensing comprises dispensing a predetermined number of discrete sheet products in response to the signal.

In certain embodiments, the method also includes folding the one or more discrete sheet products by feeding a portion of the sheet material to a buckle chamber adjacent to the sheet product conveying mechanism and forcing a fold in the sheet material through the sheet product conveying mechanism, wherein the sheet product conveying mechanism comprises a pair of pinch rollers.

Figure 7:
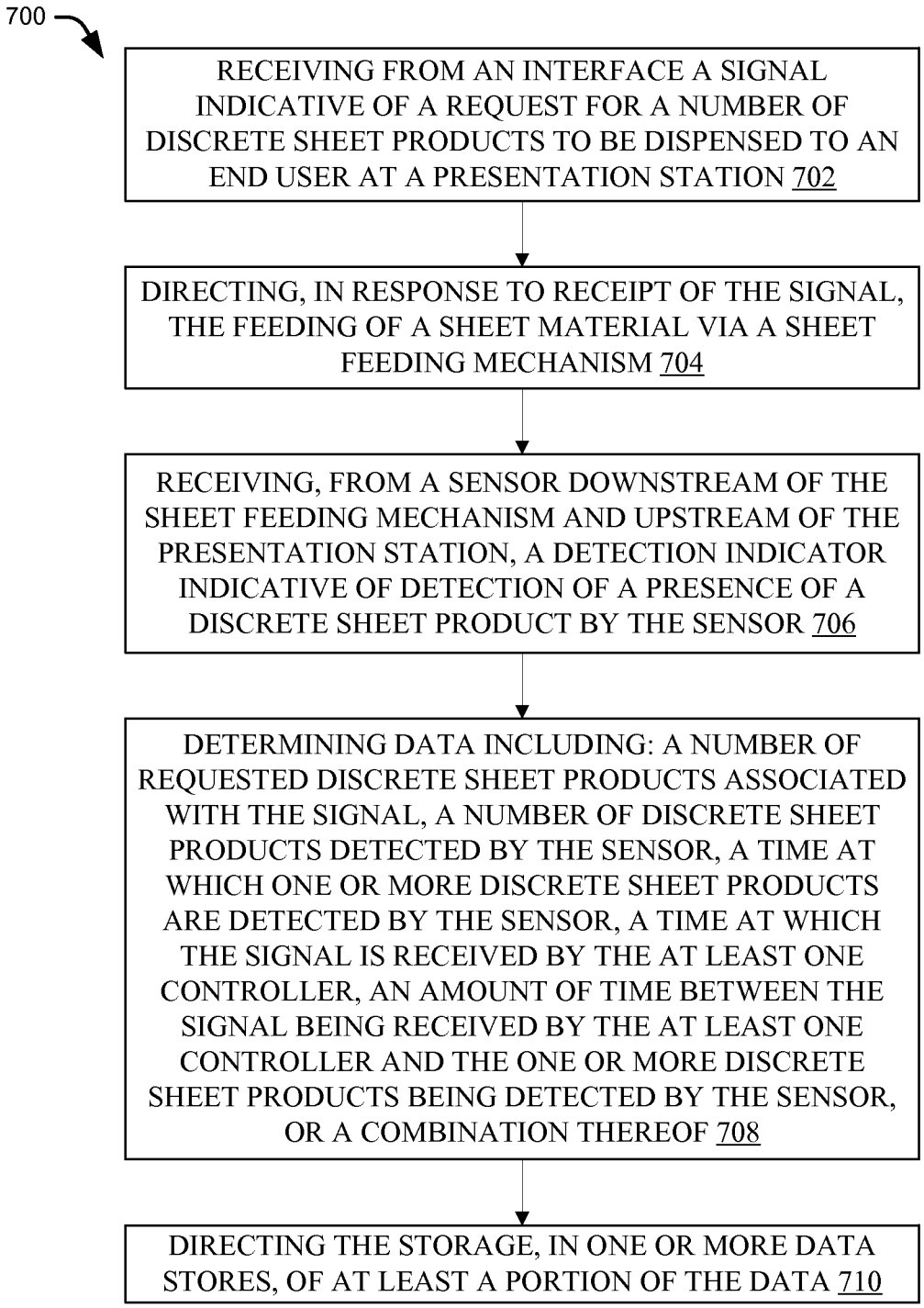
FIG. 7 is a process flow diagram of a method for dispensing sheet products.

In one embodiment, as shown in FIG. 7, a method for dispensing sheet products includes: (i) receiving from an interface, by at least one controller configured to access at least one memory, a signal indicative of a request for a number of discrete sheet products to be dispensed to an end user at a presentation station 702; (ii) directing, by the at least one controller, in response to receipt of the signal, the feeding of a sheet material via a sheet feeding mechanism 704; (iii) receiving, by the at least one controller, from a sensor downstream of the sheet feeding mechanism and upstream of the presentation station, a detection indicator indicative of detection of a presence of a discrete sheet product by the sensor 706; (iv) determining, by the at least one controller, data including: a number of requested discrete sheet products associated with the signal, a number of discrete sheet products detected by the sensor, a time at which one or more discrete sheet products are detected by the sensor, a time at which the signal is received by the at least one controller, an amount of time between the signal being received by the at least one controller and the one or more discrete sheet products being detected by the sensor, or a combination thereof 708; and (v) directing, by the at least one controller, the storage, in one or more data stores, of at least a portion of the data 710.

In certain embodiments, directing the feeding of a sheet material via a sheet feeding mechanism includes directing a motor operably connected to the at least one controller to drive the sheet feeding mechanism in response to the signal, and the data includes: a time at which the motor is turned on, a time at which the motor is turned off, a time between the motor bring turned on and the motor bring turned off, or a combination thereof. In one embodiment, the data includes the number of requested discrete sheet products associated with the signal and the number of discrete sheet products detected by the sensor, and the method further includes: comparing, by the at least one controller, the number of requested discrete sheet products associated with the signal and the number of discrete sheet products detected by the sensor; and directing stoppage, by the at least one controller, of the motor when the number of discrete sheet products detected by the sensor matches the number of requested discrete sheet products associated with the signal.

Systems

Figure 6:
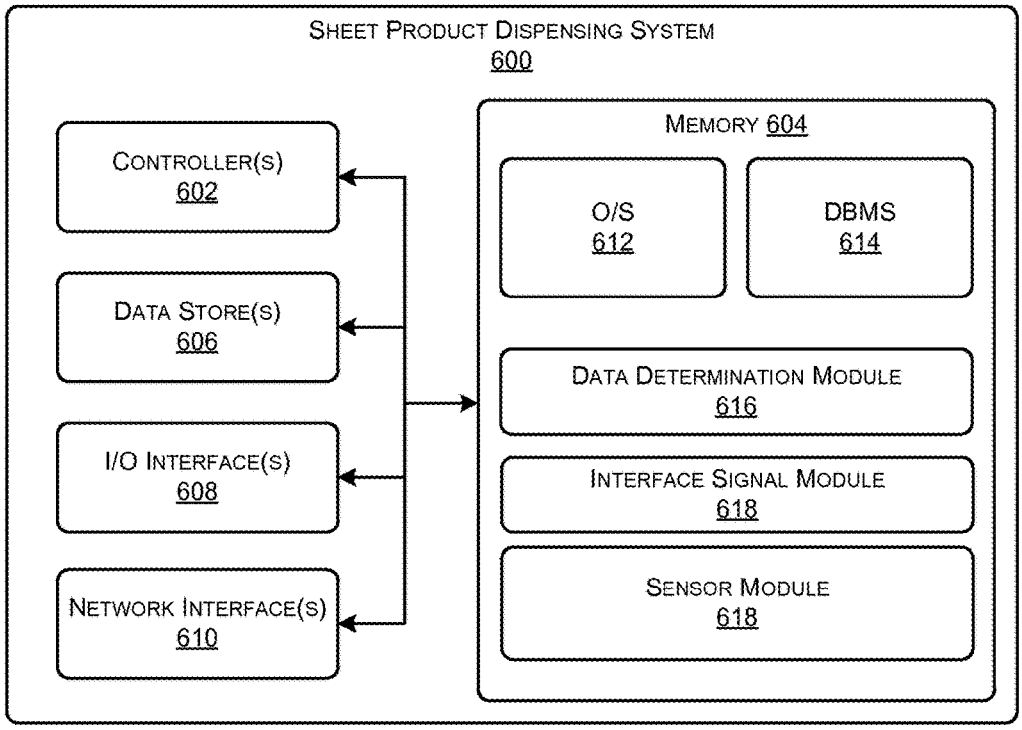
FIG. 6 is schematic block diagram illustrating various hardware and software sub-components of various components of a sheet product dispensing system architecture.

In certain embodiments, as shown in FIG. 6, a system for dispensing sheet products 600 includes: at least one memory 604 that stores computer-executable instructions and at least one controller 602 configured to access the at least one memory, wherein the at least one controller is configured to execute the computer-executable instructions to: (i) receive, from an interface, a signal indicative of a request for a number of discrete sheet products to be dispensed to an end user at a presentation station; (ii) direct, in response to receipt of the signal, the feeding of a sheet material via a sheet feeding mechanism; (iii) receive, from a sensor downstream of the sheet feeding mechanism and upstream of the presentation station, a detection indicator indicative of detection of a presence of a discrete sheet product by the sensor; (iv) determine data including: a number of requested discrete sheet products associated with the signal, a number of discrete sheet products detected by the sensor, a time at which one or more discrete sheet products are detected by the sensor, a time at which the signal is received by the at least one controller, an amount of time between the signal being received by the at least one controller and the one or more discrete sheet products being detected by the sensor, or a combination thereof; and (v) direct the storage, in one or more data stores 606, of at least a portion of the data. In one embodiment, the one or more data stores include at least a portion of the at least one memory.

In certain embodiments, the at least one controller is configured to execute the computer-executable instructions to direct the storage, in one or more data stores, of at least a portion of the data in a text line item format.

In one embodiment, the interface includes a user interface configured to transmit the signal, and the number of requested discrete sheet products associated with the signal is a predetermined number of discrete sheet products to be dispensed in response to the signal. In another embodiment, the interface includes a second sensor configured to detect an absence of discrete sheet products at the presentation station and transmit the signal to the at least one controller upon detection of the absence of discrete sheet products at the presentation station. For example, the number of requested discrete sheet products associated with the signal may be a predetermined number of discrete sheet products to be dispensed in response to the signal. In one embodiment, the data further includes the time between the discrete sheet products entering the presentation station and the absence of discrete sheet products at the presentation station.

In certain embodiments, the at least one controller is configured to execute the computer-executable instructions to direct a motor operably connected to the at least one controller to drive the sheet feeding mechanism in response to the signal. For example, the data may further include: a time at which the motor is turned on, a time at which the motor is turned off, a time between the motor bring turned on and the motor bring turned off, or a combination thereof.

In one embodiment, the data includes the number of requested discrete sheet products associated with the signal and the number of discrete sheet products detected by the sensor, and the at least one controller is configured is configured to execute the computer-executable instructions to compare the number of requested discrete sheet products associated with the signal and the number of discrete sheet products detected by the sensor, and direct stoppage of the motor when the number of discrete sheet products detected by the sensor matches the number of requested discrete sheet products associated with the signal.

As shown in FIG. 6, the controller(s) 602 may include any suitable processing unit capable of accepting digital data as input, processing the input data in accordance with stored computer-executable instructions, and generating output data. The controller(s) 602 may be configured to execute the computer-executable instructions to cause or facilitate the performance of various operations. The controller(s) 602 may be further configured to utilize and direct various hardware resources available in the sheet product dispensing system 600, to drive various peripheral features, facilitate storage of data, and so forth. The controller(s) 602 may include any type of suitable processing unit including, but not limited to, a central processing unit, a microprocessor, a microcontroller, a Reduced Instruction Set Computer (RISC) microprocessor, a Complex Instruction Set Computer (CISC) microprocessor, an Application Specific Integrated Circuit (ASIC), a Field-Programmable Gate Array (FPGA), a System-on-a-Chip (SoC), and so forth.

The memory 604 may store computer-executable instructions that are loadable and executable by the controller(s) 602 as well as data manipulated and/or generated by the controller(s) 602 during the execution of the computer-executable instructions. The memory 604 may include volatile memory (memory that maintains its state when supplied with power) such as random access memory (RAM) and/or non-volatile memory (memory that maintains its state even when not supplied with power) such as read-only memory (ROM), flash memory, and so forth. In certain embodiments, the memory 604 includes multiple different types of memory, such as various types of static random access memory (SRAM), various types of dynamic random access memory (DRAM), various types of unalterable ROM, and/or writeable variants of ROM such as electrically erasable programmable read-only memory (EEPROM), flash memory, and so forth. In certain embodiments, the memory 604 includes at least one data store.

The sheet product dispensing system 600 may further include additional data store(s) 606, such as removable storage and/or non-removable storage including, but not limited to, magnetic storage, optical disk storage, and/or tape storage. Data store(s) 606 may provide storage of computer-executable instructions and other data. The data store(s) 606 may include storage that is internal and/or external to the sheet product dispensing system 600. The memory 604 and/or the data store(s) 606, removable and/or non-removable, are examples of computer-readable storage media (CRSM).

The memory 604 may store data, computer-executable instructions, applications, and/or various program modules including, for example, one or more operating systems 612 (generically referred to herein as operating system 612), one or more database management systems (generically referred to herein as DBMS 614), and one or more program modules such as data determination module 616, interface signal module 618, and sensor module 618.

The operating system (O/S) 612 may provide an interface between other applications and/or program modules executable by the dispensing system 600 (e.g., any of the various program modules) and hardware resources of the system 600. More specifically, the O/S 612 may include a set of computer-executable instructions for managing hardware resources of the dispensing system 600 and for providing common services to other applications and/or program modules (e.g., managing memory allocation among various applications and/or program modules). The O/S 612 may include any operating system now known or which may be developed in the future including, but not limited to, any desktop or laptop operating system, any server operating system, any mobile operating system, any mainframe operating system, or any other proprietary or non-proprietary operating system.

The DBMS 614 may support functionality for accessing, retrieving, storing, and/or manipulating data stored in one or more data stores provided externally to the dispensing system 600 and/or one or more internal data stores provided, for example, as part of the data store(s) 606. The DBMS 614 may use any of a variety of database models (e.g., relational model, object model, etc.) and may support any of a variety of query languages. For example, the DBMS may allow for external accessing and retrieving of the data.

The sheet product dispensing system 600 may further include one or more I/O interfaces 608 that may facilitate receipt, by the dispensing system 600, of information input via one or more I/O devices configured to communicate with the dispensing system 600 as well as the outputting of information from the dispensing system 600 to the one or more I/O devices. The I/O devices may include, but are not limited to, a user interface such as buttons or a hand wave sensor, a display, a keypad, a keyboard, a pointing device, a control panel, a touch screen display, a remote control device, a speaker, a microphone, a printing device, other peripheral devices, and so forth.

The dispensing system 600 may further include one or more network interfaces 610 that may facilitate communication between the dispensing system 600 and other components. For example, the network interface(s) 610 may facilitate interaction between the dispensing system 600 and one or more cash registers, an external data collection device, and so forth.

Those of ordinary skill in the art will appreciate that any of the components of the sheet product dispensing system 600 may include alternate and/or additional hardware, software, or firmware components beyond those described or depicted without departing from the scope of the disclosure. More particularly, it should be appreciated that software, firmware, or hardware components depicted as forming part of any of the components of the dispensing system 600 are merely illustrative and that some components may not be present or additional components may be provided in various embodiments.

While various program modules have been depicted and described with respect to various illustrative components of the dispensing system 600, it should be appreciated that functionality described as being supported by the program modules may be enabled by any combination of hardware, software, and/or firmware. It should further be appreciated that each of the above-mentioned modules may, in various embodiments, represent a logical partitioning of supported functionality. This logical partitioning is depicted for ease of explanation of the functionality and may not be representative of the structure of software, firmware and/or hardware for implementing the functionality. Accordingly, it should be appreciated that functionality described as being provided by a particular module may, in various embodiments, be provided at least in part by one or more other modules. Further, one or more depicted modules may not be present in certain embodiments, while in other embodiments, additional modules not depicted may be present and may support at least a portion of the described functionality and/or additional functionality. Moreover, while certain modules may be depicted and described as sub-modules of another module, in certain embodiments, such modules may be provided as independent modules.

While the disclosure has been described with reference to a number of embodiments, it will be understood by those skilled in the art that the disclosure is not limited to such disclosed embodiments. Rather, the disclosed embodiments can be modified to incorporate any number of variations, alterations, substitutions, or equivalent arrangements not described herein, but which are commensurate with the spirit and scope of the disclosure.

What is claimed is:

1. A dispensing system, comprising:

a sheet feeding mechanism configured to feed sheet material from a roll of sheet material;

a separation mechanism for separating one or more discrete sheet products from the roll of sheet material;

a presentation station for presenting the one or more discrete sheet products to an end user;

a sheet product conveying mechanism configured to convey the one or more discrete sheet products to the presentation station;

a sensor downstream of the sheet feeding mechanism and upstream of the sheet product conveying mechanism, the sensor being configured to detect a presence of the sheet material; and a controller configured to facilitate dispensing of the one or more discrete sheet products to the presentation station in response to a signal, wherein the signal is initiated at a cash register, a display, a keypad, a keyboard, a pointing device, a touch screen display, a control panel, or a microphone.

2. The system of claim 1, wherein the signal is initiated at the cash register in response to an order being completed at the cash register.

3. The system of claim 1, wherein the controller is configured to receive and store data comprising data associated with the sensor.

4. The system of claim 3, wherein the data includes sales, usage, or other data associated with the cash register.

5. The system of claim 1, further comprising one or more network interfaces that facilitate communication between the cash register and the controller.

6. The system of claim 1, further comprising a folding station for providing a fold or crease in the one or more discrete sheet products downstream of the sheet feeding mechanism and prior to presentation at the presentation station.

7. The system of claim 6, wherein the sheet product conveying mechanism comprises a pair of pinch rollers and the folding station comprises a buckle chamber adjacent to the pair of pinch rollers, such that a portion of the sheet material enters the buckle chamber and a fold in the sheet material is forced through the pair of pinch rollers.

8. The system of claim 6, wherein the sensor is configured to detect a presence of the sheet material at the folding station.

9. The system of claim 1, wherein the separation mechanism comprises a speed differential separation mechanism that comprises the sheet feeding mechanism being driven at a first speed and the sheet product conveying mechanism being driven at a second speed that is higher than the first speed.

10. The system of claim 1, wherein the sensor is an infrared sensor.

11. A method of dispensing sheet products, comprising:

feeding sheet material from a roll via a sheet feeding mechanism;

separating one or more discrete sheet products from the roll via a separation mechanism;

dispensing the one or more discrete sheet products at a presentation station via a sheet product conveying mechanism, in response to a signal received by a controller from a cash register, a display, a keypad, a keyboard, a pointing device, a touch screen display, a control panel, or a microphone; and detecting a presence of the sheet material via a sensor downstream of the sheet feeding mechanism and upstream of the sheet product conveying mechanism.

12. The method of claim 11, wherein the signal is initiated at the cash register in response to an order being completed at the cash register.

13. The method of claim 11, further comprising collecting and storing data comprising data associated with the sensor.

14. The method of claim 13, wherein the data includes sales, usage, or other data associated with the cash register.

15. The method of claim 11, further comprising transmitting the signal to the controller via a network interface between the cash register and the controller.

16. The method of claim 11, further comprising folding the sheet material at a folding station downstream of the sheet feeding mechanism.

17. The method of claim 16, wherein folding the one or more discrete sheet products comprises feeding a portion of the sheet material to a buckle chamber adjacent to the sheet product conveying mechanism and forcing a fold in the sheet material through the sheet product conveying mechanism, wherein the sheet product conveying mechanism comprises a pair of pinch rollers.

18. The method of claim 16, wherein the sensor is configured to detect a presence of the sheet material at the folding station.

19. The method of claim 11, wherein the separation mechanism comprises a cutting mechanism or a speed differential separation mechanism.

20. The method of claim 19, wherein the speed differential mechanism comprises driving the sheet feeding mechanism at a first speed and the sheet product conveying mechanism at a second speed that is higher than the first speed.

* * * * *